US006626710B1

(12) United States Patent
Tsai Huang

(10) Patent No.: US 6,626,710 B1
(45) Date of Patent: Sep. 30, 2003

(54) SIGNAL PLUG STRUCTURE

(76) Inventor: Shun-Chih Tsai Huang, 3F, No. 16, Lane 17, Shian Bei St., Tainan (TW)

( * ) Notice: Subject to any disclaimer, the term of this patent is extended or adjusted under 35 U.S.C. 154(b) by 0 days.

(21) Appl. No.: 10/259,618

(22) Filed: Sep. 30, 2002

(51) Int. Cl.[7] ..... H01R 13/05
(52) U.S. Cl. ..... 439/825; 439/669
(58) Field of Search ..... 439/825, 669, 439/668

(56) References Cited

U.S. PATENT DOCUMENTS 4,836,804 A * 6/1989 London et al. ..... 439/598
5,727,983 A * 3/1998 Koldste ..... 446/428
5,809,192 A * 9/1998 Manning et al. ..... 385/78
5,898,993 A * 5/1999 Inaba et al. ..... 29/874
6,533,617 B1 * 3/2003 D'Addario ..... 439/669

* cited by examiner

*Primary Examiner*—Chau N. Nguyen
*Assistant Examiner*—Jinhee Lee
(74) *Attorney, Agent, or Firm*—Rosenberg, Klein & Lee

(57) ABSTRACT

A signal plug structure includes a conductive bar, a conductive shaft and a sleeve. The conductive bar includes a reduced section thereof adapted to receive an elastic ring thereon. The elastic ring is made of a piece of thin metal being curved to an arcuate shape with cut-off sections thereon. Upon the conductive bar is inserted into a terminal, the elastic ring will be pressed by the inner wall of the terminal inwardly, thus the elastic ring produces an expansion force against the inner wall. This tightens the connection of the conductive bar and the terminal, and makes the conductive bar be able to fit any different size of terminal.

2 Claims, 4 Drawing Sheets

SIGNAL PLUG STRUCTURE

FIELD OF THE INVENTION

This invention relates to a signal plug structure, in particular to a signal plug with an elastic ring, which expands to form a tight connection with the inner wall of the terminal with various sizes.

Electronic equipments such as CD, DVD and HI-FI stereo, and no matter of what electronic equipment, all have either audio or video or both signals to be output to a speaker or a monitor. The signal transmission requires a media to do the job. Currently, signal wire is adapted to transmit the signal from one end to the other end, this wire is important in the quality of the signal output. The signal wire comprises a pair of heads at respective ends, the heads play an important role of transmitting a quality signal.

A signal plug A of a prior art, as shown in FIG. 4, comprises a conductive bar A1 having connected at its front end through an insulating ring A2 to a conductive head A3, the other end of the conductive bar A1 is covered with a sleeve A4. By inserting the two conductive bars at respective ends of the signal wire, signal is transmitted from one unit to the other unit through the signal wire. However, a constant plug and unplug of the conductive bars in and out from a terminal enlarges the size of the terminal and causes loosening of the connection, thus affects the quality of signal.

In view of this, the present inventor has derived a conductive bar to improve all of the above-mentioned shortcomings.

SUMMARY OF THE INVENTION

It is the primary object of the present invention to provide a signal plug structure, which maintains a tight connection to ensure a better quality of signal transmission.

It is another object of the present invention to provide a signal plug structure, which fits to different sizes of terminals.

It is a further object of the present invention to provide a signal plug structure, which modification is little and is cost effectiveness in manufacture.

DETAILED DESCRIPTION OF THE PREFERRED EMBODIMENT

Figure 1:
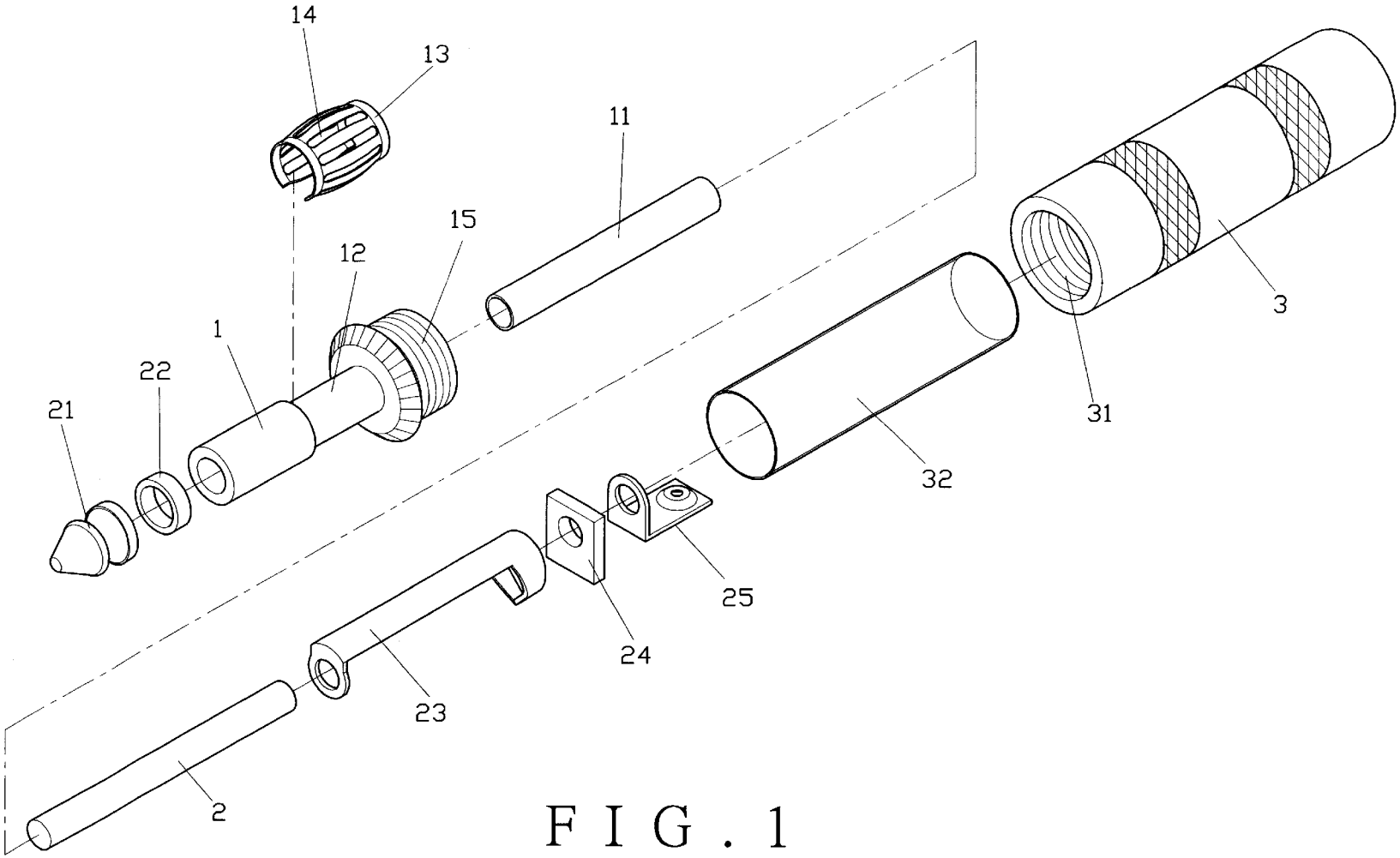
FIG. 1 is an exploded view of the present invention.

A signal plug structure for an electric equipment of the present invention comprises a conductive bar 1, a conductive shaft 2, and a sleeve 3, as shown in FIG. 1.

The conductive bar 1 comprises a hollow insulating tube 11 inwardly, with a reduced section 12 adapted to receive an elastic ring 13 thereon, which is made of a piece of thin curved metal with cut-off sections 14, the rear end of the conductive bar 1 is formed with threads 15 thereat.

The conductive shaft 2 is to be placed in the hollow tube 11 of the conductive bar 1, and is connected at its front end through an insulating ring 22 to a conductive head 21, the rear end of the conductive shaft 2 connects with a large wire clip 23, a square insulating element 24 and a small wire clip 25.

The sleeve 3 is connected with the rear end of the conductive bar 1 in a threaded manner, and comprises inner threads 31 at the front end and an insulating tube 32 at inside thereof.

Figure 2:
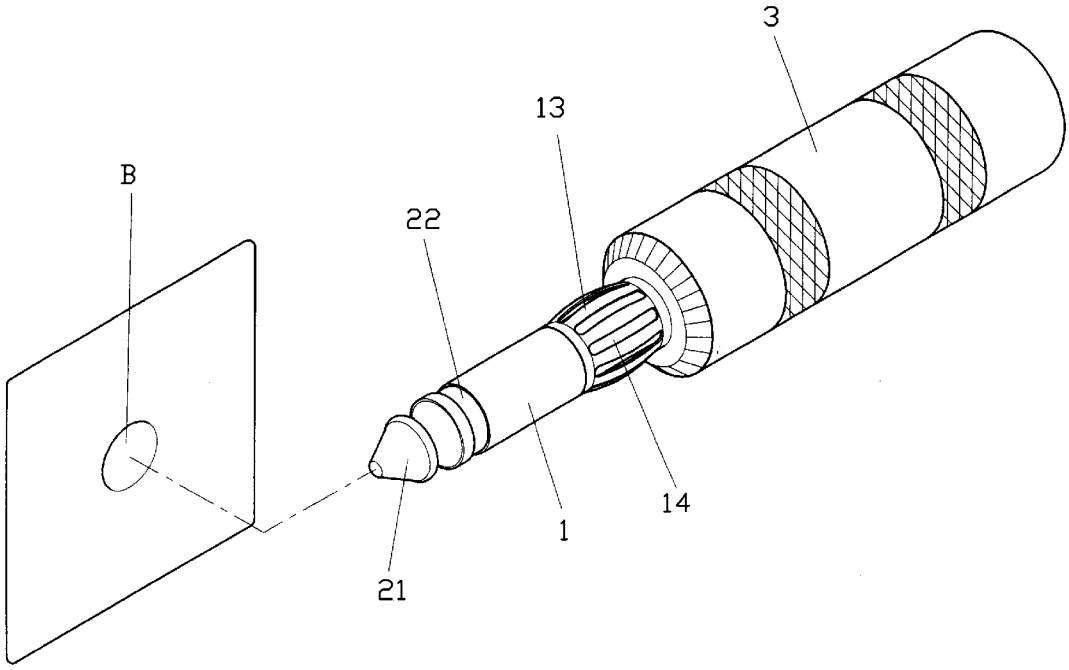
FIG. 2 is a perspective view of the present invention.
Figure 3:
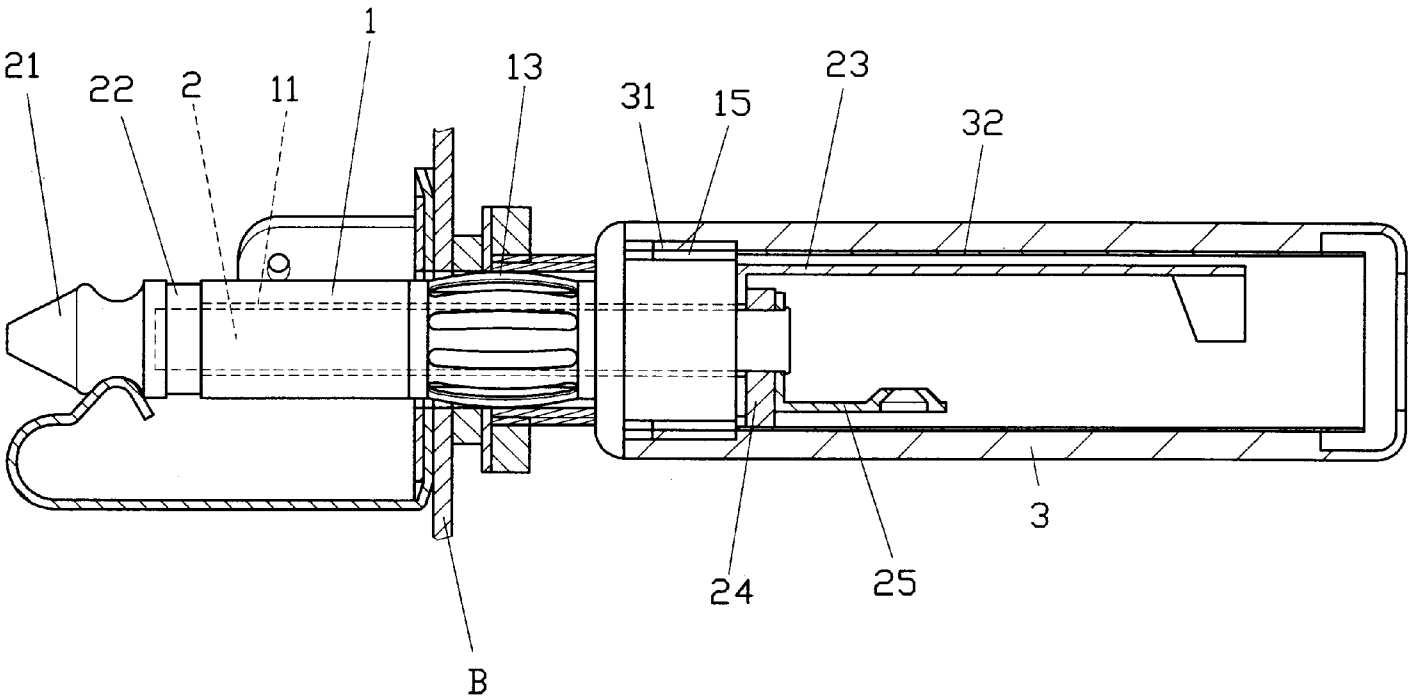
FIG. 3 is a side cross-sectional view of the present invention.
Figure 4:
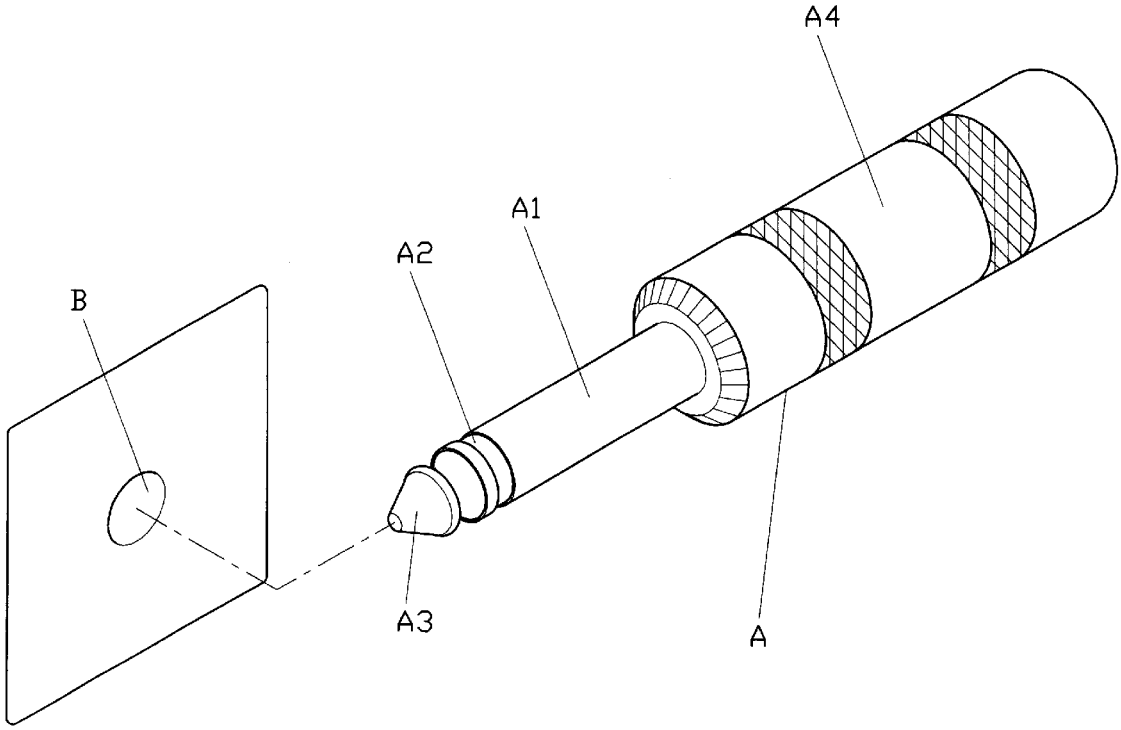
FIG. 4 (PRIOR ART)
FIG. 4 is a perspective view of a prior art of a signal plug.

To assemble the present invention, as shown in FIGS. 2 and 3, the front end of the conductive shaft 2 is connected with the conductive head 21 with the insulating ring 22 located between the conductive shaft 2 and the conductive head 21. The rear section of the conductive shaft 2 is sleeved with the large wire clip 23, the insulating element 24 and the small wire clip 25, and the rear end of the conductive shaft 2 is riveted securely so that the large wire clip 23, the insulating element 24 and the small wire clip 25 are fastened to the rear end of the threaded section 15 of the conductive bar 1. The elastic ring 13 is sleeved onto the reduced section 12 of the conductive bar 1, and then the large wire clip 23 and the small wire clip 25 are connected with positive and negative wires respectively, whereas the large wire clip 23 is connected to the conductive bar 1 and the small wire clip 25 is connected to the conductive shaft 2. The large wire clip 23 and the small wire clip 25 are insulated by the insulating element 24, while the conductive bar 1 and the conductive shaft 2 are insulated by the insulating ring 22. Lastly, the insulating sleeve 32 is sleeved into the sleeve 3 and the threads 15 of the conductive bar 1 are threaded with the front inner threads 31 of the sleeve 3. This completes the assembly of the present invention.

To operate the present invention, as shown in FIG. 3, when the conductive bar 1 is inserted into a terminal B, the elastic ring 13 on the reduced section 12 of the conductive bar 1 will be pressed to deform inwardly, this forces the elastic ring 13 to produce a bouncing force to engage with the inner wall of the terminal B and holds the plug firmly within the terminal B. Even though the plug is inserted into a different size of terminal B, the elastic ring 13 can still assist the plug to hold in the terminal B firmly.

I claim:

1. A signal plug structure of the present invention comprising a conductive bar, a conductive shaft, and a sleeve, wherein said conductive bar being a hollow tube having a hollow insulating tube therein;

said conductive shaft located in said insulating tube of said conductive bar, said plug comprising a conductive head and an insulating ring secured to the front end while the rear end of said conductive shaft being secured with a large wire clip, an insulating element and a small wire clip;

said sleeve secured to the rear end of said conductive bar, having an insulating tube within said sleeve, said plug also being characterized by that:

said conductive bar comprising a reduced section to receive an elastic ring thereon, said elastic ring being made of a piece of thin curved metal with cut-off sections thereon.

2. The signal plug structure, as claimed in claim 1, wherein the rear end of said conductive bar comprises threads, and said sleeve comprises inner threads at the front end for connection with said threads of said conductive bar.

* * * * *